US009115960B2

(12) United States Patent
Kim

(10) Patent No.: US 9,115,960 B2
(45) Date of Patent: Aug. 25, 2015

(54) DEFENSE STRUCTURE FOR NATIONAL DEFENSE

(75) Inventor: Jang Hoon Kim, Suwon-si (KR)

(73) Assignee: AJOU UNIVERSITY INDUSTRY-ACADEMIC COOPERATION FOUNDATION, Gyeonggi-Do (KR)

( * ) Notice: Subject to any disclaimer, the term of this patent is extended or adjusted under 35 U.S.C. 154(b) by 0 days.

(21) Appl. No.: 14/130,934

(22) PCT Filed: Jul. 6, 2012

(86) PCT No.: PCT/KR2012/005367

§ 371 (c)(1),
(2), (4) Date: Jan. 6, 2014

(87) PCT Pub. No.: WO2013/006008

PCT Pub. Date: Jan. 10, 2013

(65) Prior Publication Data

US 2014/0230639 A1 Aug. 21, 2014

(30) Foreign Application Priority Data

Jul. 6, 2011 (KR) ..... 10-2011-0066949

(51) Int. Cl.
*F41H 5/24* (2006.01)
*F42D 5/045* (2006.01)

(52) U.S. Cl.
CPC . *F41H 5/24* (2013.01); *F42D 5/045* (2013.01)

(58) Field of Classification Search
CPC ..... F41H 5/24; F41H 5/02; F41H 5/0492; F41H 7/044; F42D 5/045
USPC ..... 89/36.02, 36.04; 428/911
See application file for complete search history.

(56) References Cited

U.S. PATENT DOCUMENTS

| | | | | | |
|---|---|---|---|---|---|
| 787,065 | A | * | 4/1905 | White | 114/12 |
| 2,181,466 | A | * | 11/1939 | Shackett | 52/660 |
| 2,348,130 | A | * | 5/1944 | Hardy, Jr. | 109/84 |
| 2,744,042 | A | * | 5/1956 | Pace | 264/46.5 |
| 3,649,426 | A | * | 3/1972 | Gates, Jr. | 428/68 |
| 3,895,152 | A | * | 7/1975 | Carlson et al. | 428/116 |
| 3,969,563 | A | * | 7/1976 | Hollis, Sr. | 428/175 |
| 4,198,454 | A | * | 4/1980 | Norton | 428/117 |
| 4,251,579 | A | * | 2/1981 | Lee et al. | 428/73 |
| 4,501,101 | A | * | 2/1985 | Davis | 52/404.3 |
| 4,625,710 | A | * | 12/1986 | Harada et al. | 126/619 |
| 4,763,457 | A | * | 8/1988 | Caspe | 52/504 |
| 4,964,936 | A | * | 10/1990 | Ferro | 156/242 |
| 5,471,905 | A | * | 12/1995 | Martin | 89/36.02 |
| 5,654,518 | A | * | 8/1997 | Dobbs | 89/36.02 |
| 5,686,689 | A | | 11/1997 | Snedeker et al. | |

(Continued)

FOREIGN PATENT DOCUMENTS

JP 2002-337256 A 11/2002

*Primary Examiner* — Joshua Freeman
(74) *Attorney, Agent, or Firm* — Revolution IP, PLLC

(57) ABSTRACT

Provided is a defense structure for national defense including: a hollow structure which extends from the ground or from underground so as to protect the interior of the defense structure from the concussive or explosive forces of shells or rockets, and which has a plurality of cells which are hollow and are partitioned by cell walls, wherein the plurality of cells are arranged in a set, three-dimensional pattern; and a cladding for surrounding the outside of the hollow structure; and a filler that is selectively filled in hollow portions of the cells.

8 Claims, 12 Drawing Sheets

(56) References Cited

U.S. PATENT DOCUMENTS

| | | | | |
|---|---|---|---|---|
| 6,418,832 | B1 * | 7/2002 | Colvin | 89/36.02 |
| 6,828,001 | B2 | 12/2004 | Tokonabe et al. | |
| 6,973,864 | B1 | 12/2005 | Ahmad | |
| 7,608,314 | B2 * | 10/2009 | Plant | 428/86 |
| 8,544,240 | B2 * | 10/2013 | Hughes, Jr. | 52/783.17 |
| 2004/0050239 | A1 | 3/2004 | Benyami et al. | |
| 2005/0262998 | A1 * | 12/2005 | Ahmad | 89/36.02 |
| 2008/0092471 | A1 * | 4/2008 | Ahmad | 52/322 |
| 2009/0235507 | A1 * | 9/2009 | Cashin et al. | 29/402.08 |
| 2011/0283873 | A1 * | 11/2011 | Wadley et al. | 89/36.02 |
| 2012/0144987 | A1 * | 6/2012 | Ficht et al. | 89/36.02 |
| 2012/0216670 | A1 * | 8/2012 | McDonald et al. | 89/36.02 |
| 2012/0247311 | A1 * | 10/2012 | Warner et al. | 89/36.01 |
| 2012/0247312 | A1 * | 10/2012 | Adams et al. | 89/36.02 |
| 2014/0007543 | A1 * | 1/2014 | Adel | 52/741.1 |
| 2014/0130657 | A1 * | 5/2014 | Pilpel et al. | 89/36.02 |

* cited by examiner

DEFENSE STRUCTURE FOR NATIONAL DEFENSE

CROSS REFERENCE TO PRIOR APPLICATIONS

This application is a National Stage Application of PCT International Patent Application No. PCT/KR2012/005367 filed on Jul. 6, 2012, under 35 U.S.C. §371, which claims priority to Korean Patent Application No. 10-2011-0066949 filed on Jul. 6, 2011, which are all hereby incorporated by reference in their entirety.

TECHNICAL FIELD

The present invention relates to a defense structure for national defense, and more particularly, to a defense structure for national defense, which is installed to protect the interior thereof from external attacks such shelling attacks or missile attacks.

BACKGROUND ART

In general, protection structures for protecting human life and major facilities from external attacks or dangerous materials due to enemy's shelling with shells or missiles are built not only on military sites but also in areas near the military sites. The protection structures are built with thick walls and slabs in the form as a bunker using earth or reinforced concrete and are installed on the ground or underground.

The recent North's shelling onto Yeonpyeong Island vividly shows that not only military sites but even civilian facilities could be exposed to attacks any time under the current situation of inter-Korean confrontation. It points out that underground bunkers or protection structures for protecting human life from such attacks and an efficient operating policy therefor are required.

Moreover, if the currently used reinforced concrete bunkers or protection structures are damaged by an attack, cracks may develop in all directions due to solid properties of sections of materials of the bunkers or the protection structures, and damages are likely to spread to the entire sections. If the thickness of the bunkers or the protection structures is increased to prevent this, a vast amount of material has to be consumed, and the weight of the bunkers and protection structures also increase.

Thus, the needs arises for establishing a protection structure, which localizes a range of collapse in an attack by an enemy to thereby minimize damages of military units or civilians, which is further applicable to major national security facilities and military reservation facilities, and which is economical and is equipped with multiple safeguards.

DETAILED DESCRIPTION OF THE INVENTION

Technical Problem

The present invention provides a defense structure for national defense, which has an improved structure to localize a range of collapse with respect to a shelling with shells or missiles by an enemy to thereby minimize damages to people and goods in the interior of the defense structure.

Technical Solution

According to an aspect of the present invention, there is provided a defense structure for national defense comprising: a hollow structure which extends from the ground or from underground so as to protect the interior of the defense structure from the concussive or explosive forces of shells or rockets, and which has a plurality of cells which are hollow and are partitioned by cell walls, wherein the plurality of cells are arranged in a set, three-dimensional pattern; and a cladding for surrounding the outside of the hollow structure; and a filler that is selectively filled in hollow portions of the cells.

The filler may include a nonflammable fiber or a fluid.

At least one stiffener may be inserted into the cell walls.

At least one connection hole through which the hollow portions formed in the cells are fluidly connected to one another may be formed in each of the cell walls.

The defense structure for national defense may further include a plurality of tubes that are respectively inserted into the connection holes.

The cells may have a cross-section having a form selected from the group consisting of a circle, an oval, a polygon, and a closed shape formed by combining a curve and a straight line.

The defense structure for national defense may further include a plurality of molds that respectively tightly contact inner walls of the plurality of cells by surface contact.

The defense structure for national defense may further include a plurality of connectors that respectively pass through the cell walls to connect and support the plurality of molds.

The molds may be formed of a soft material having flexibility.

The molds may be formed of a plastic or an inflated vinyl.

Effect of the Invention

According to the defense structure for national defense, following effects may be obtained.

First, as the defense structure includes a plurality of cells partitioned by cell walls and hollow portions, the total weight of the defense structure is reduced but appropriate rigidity and strength thereof may be maintained compared to the reduced weight.

Secondly, the plurality of cells are arranged in a set, three-dimensional pattern and the hollow portions are formed in the cells, and thus, development of cracks due to an impact applied over the entire walls by shells or missiles may be delayed, thereby locally restricting damages to defense walls.

Thirdly, a stiffener such as reinforced fibers having a mesh structure is inserted into the cell walls, thereby suppressing penetration of enemy's shells through the cell walls.

Fourthly, the function of (the defense structure?) may be improved as a nonflammable fiber or a functional fluid is filled in the hollow portions formed by the cells of a hollow structure, and thus, risk of fire which may break out due to shelling attacks may be reduced and progression of the shells may be obstructed so that damages to defense walls are further localized.

BEST MODE

Hereinafter, preferred embodiments of the present invention will now be described with reference to the attached drawings.

Figure 1:
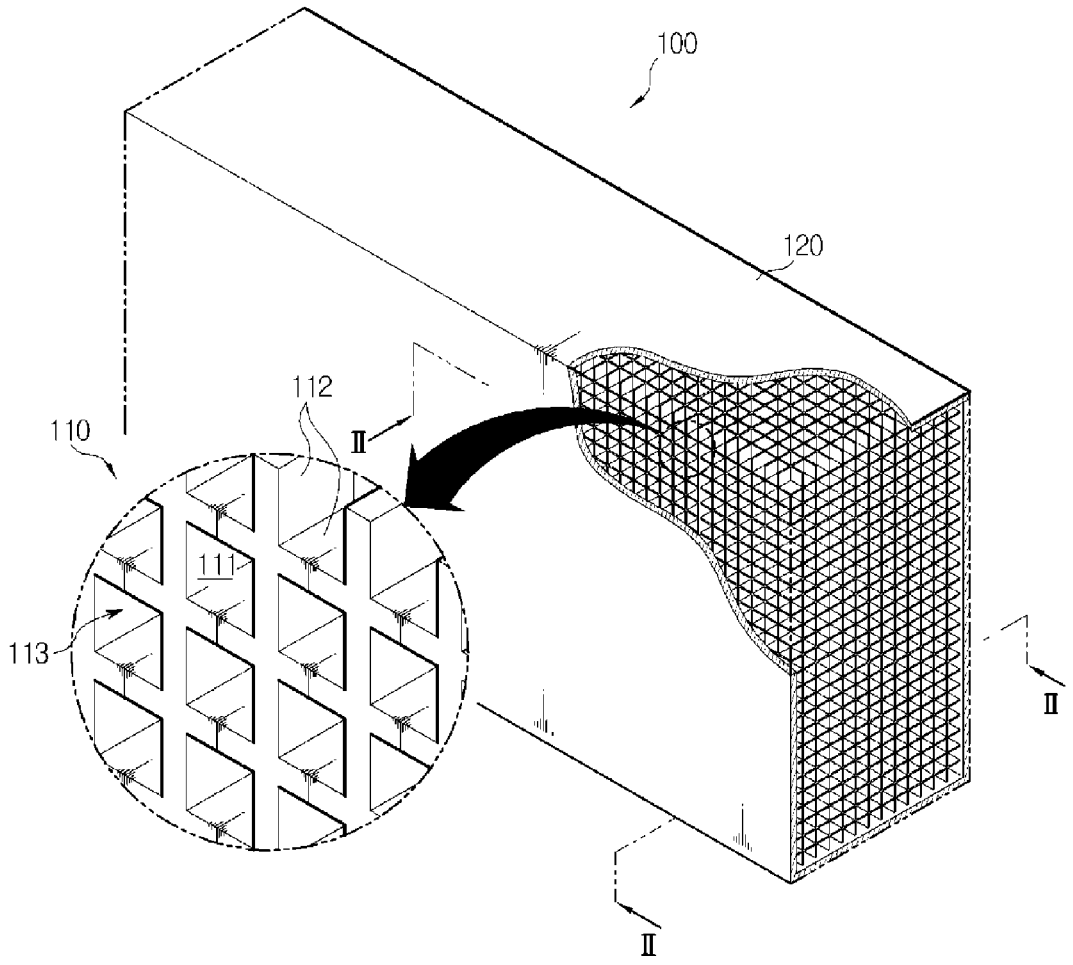
FIG. 1 is a partially cutaway perspective view of a defense structure for national defense according to an embodiment of the present invention.
Figure 2:
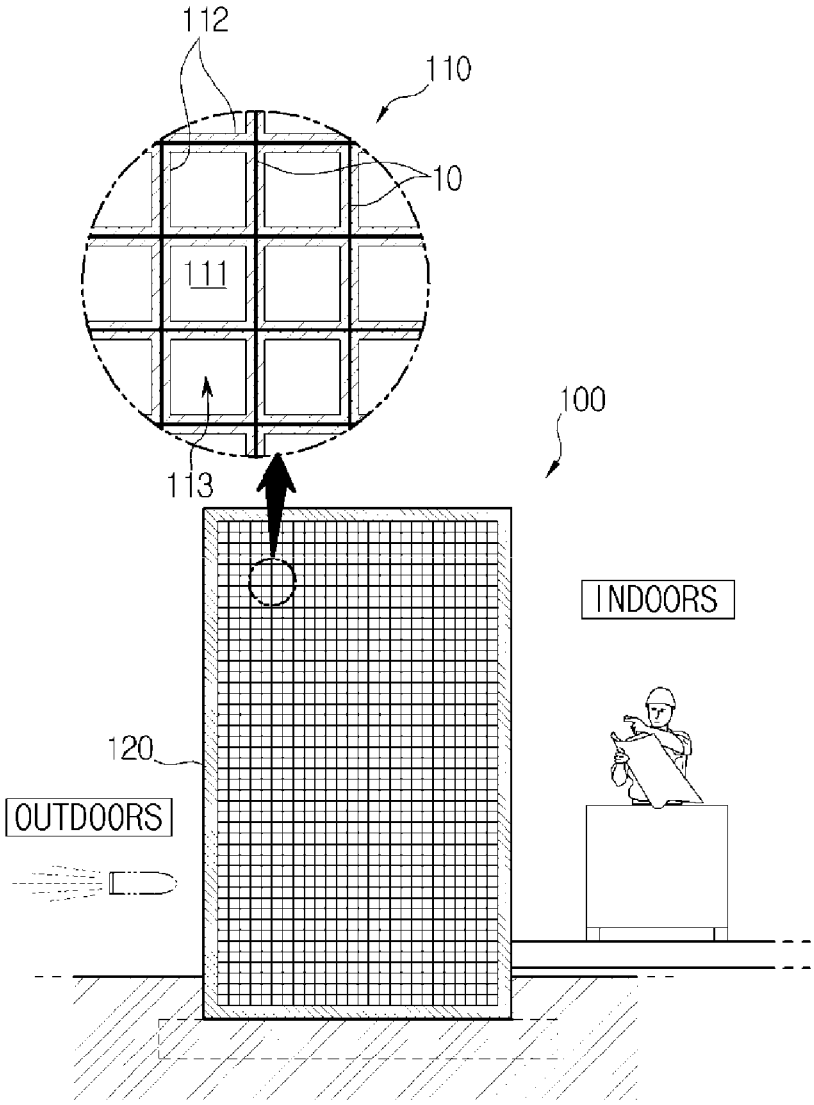
FIG. 2 is a cross-sectional view of FIG. 1 cut along a line II-II, in which a stiffener is inserted into cell walls.
Figure 3:
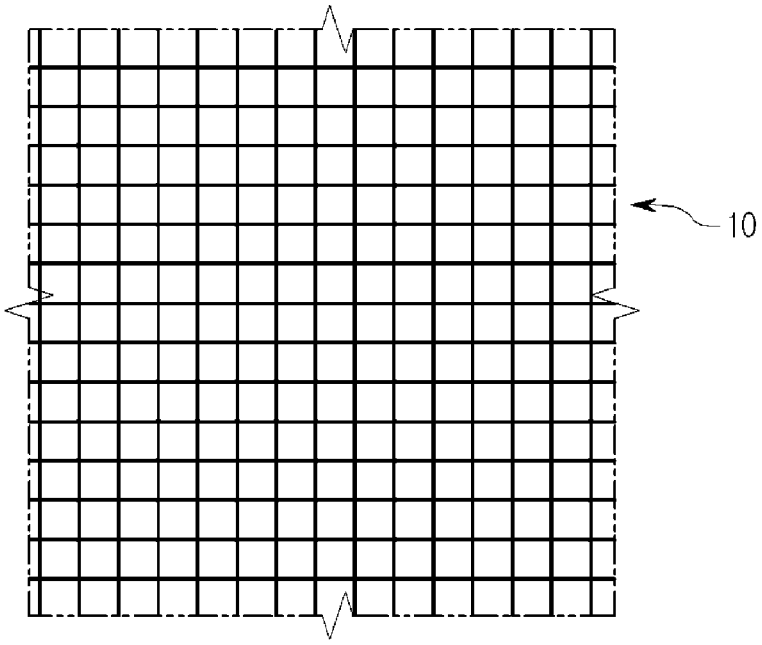
FIG. 3 is a front view illustrating the stiffener illustrated in FIG. 2.
Figure 4:
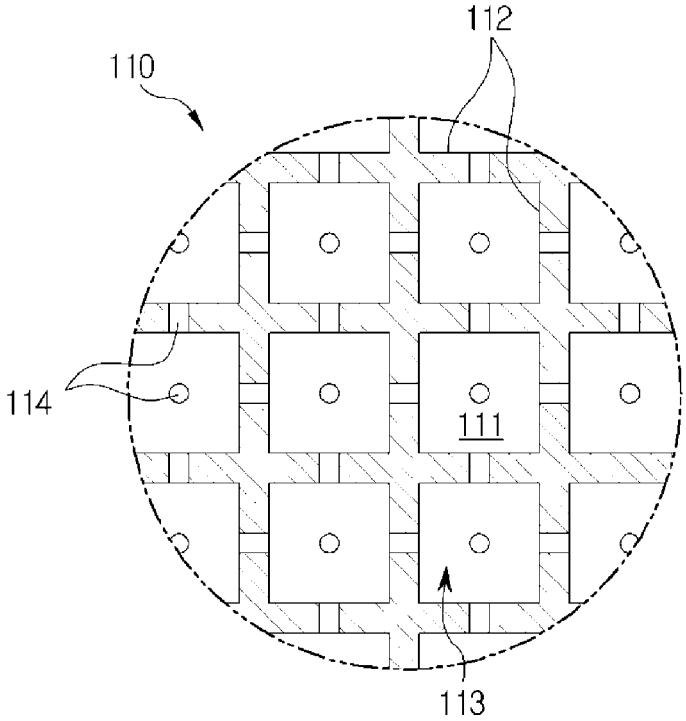
FIG. 4 is a cross-sectional view illustrating a state in which a connection hole is formed in a hollow structure illustrated in FIG. 2.

FIG. 1 is a partially cutaway perspective view of a defense structure for national defense according to an embodiment of the present invention. FIG. 2 is a cross-sectional view of FIG. 1 cut along a line II-II, in which a stiffener is inserted into cell walls. FIG. 3 is a front view illustrating the stiffener illustrated in FIG. 2. FIG. 4 is a cross-sectional view illustrating a state in which a connection hole is formed in a hollow structure illustrated in FIG. 2.

Figure 5:
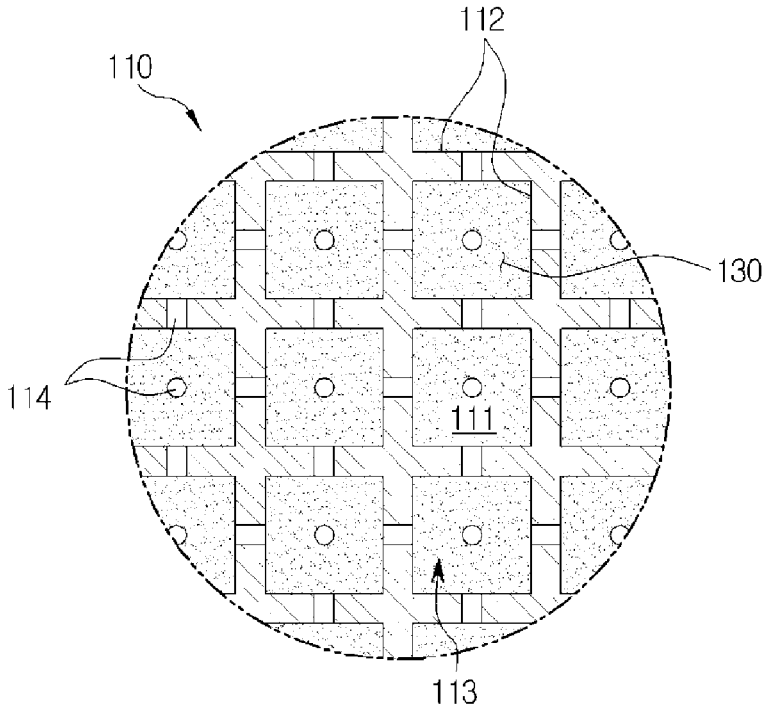
FIG. 5 is a cross-sectional view illustrating a nonflammable fiber filled in cells illustrated in FIG. 2.
Figure 6:
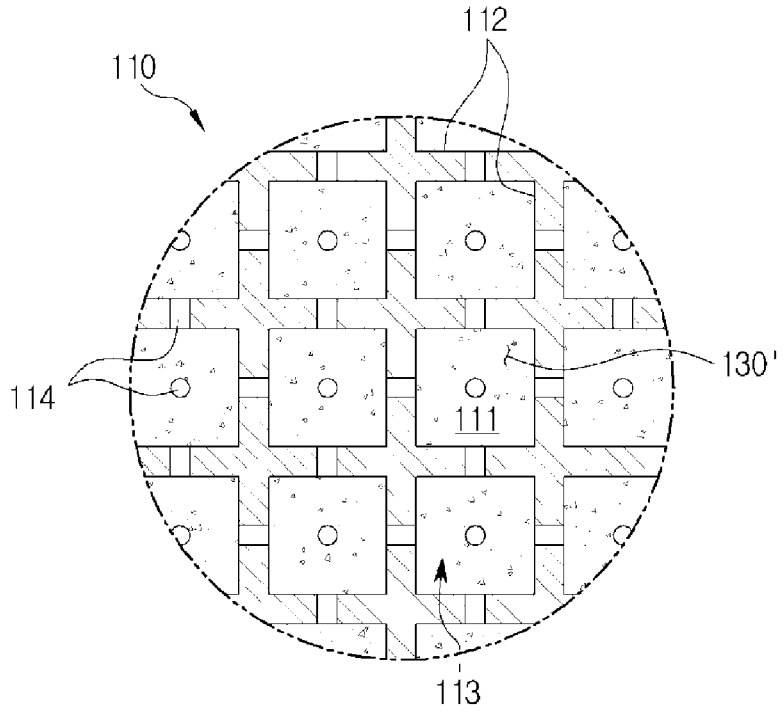
FIG. 6 is a cross-sectional view illustrating a state in which a fluid is filed in the cells illustrated in FIG. 4.

Also, FIG. 5 is a cross-sectional view illustrating a nonflammable fiber filled in cells illustrated in FIG. 2, and FIG. 6 is a cross-sectional view illustrating a state in which a fluid is filed in the cells illustrated in FIG. 4.

Referring to FIGS. 1 through 6, the defense structure 100 for national defense 100 includes a hollow structure 110, a cladding 120, and a filler 130.

The hollow structure 110 includes a plurality of cells 112 that are partitioned by cell walls 113. The plurality of cells 112 are arranged in a set, three-dimensional pattern. In addition, the cell walls 113 are arranged in length, height, and width directions to form a plurality of hollow portions 111.

The hollow structure 110 has an overall rectangular parallelepiped shape and extends from the ground or from underground, but this is exemplary; as long as the hollow structure 110 may extend from the ground or from underground, the shape of the hollow structure 110 is not limited. The hollow structure 110 functions as a defense facility to protect the interior from shells of an enemy. Furthermore, as long as the hollow structure 110 is capable of protecting the interior from enemy's shells, the shape thereof may be various. That is, the hollow structure 110 may be installed outside to surround the interior or may be formed in a dome shape so that not only the interior but also the entire defense structure is covered by the hollow structure 110.

Meanwhile, as illustrated in FIG. 2, a foundation may be laid underground. The foundation may be laid in a predetermined length direction with a predetermined length, and the hollow structure 110 is coupled to an upper portion of the foundation. In this manner, the hollow structure 110 is fixed to the foundation that is underground.

Also, In FIGS. 1 and 2, the cell walls 113 that partition the plurality of cells 112 and that are formed as a single unit are illustrated. However, forming the cell walls 113 as a single unit is exemplary, and instead, unit cells which are not formed as a single unit may be coupled to one another using an adhesive layer (not shown), or a cell unit (not shown) formed of a plurality of cells that are coupled to one another using an adhesive layer may be provided.

The cells 112 may be arranged, for example, in a matrix. However, a method of arranging the cells 112 is not limited to a matrix, and the cells 112 may be arranged in other various manners. Also, the cell walls 113 that partition the cells 112 may be formed of any material as long as the cell walls 113 may structurally maintain a stress. That is, the cell walls 113 may be formed of concrete, a ceramic, a synthetic resin, or a metal. Also, according to necessity, the cell walls 113 may be formed of a stiffener such as a reinforcing bar, a wired mesh or a reinforcing fiber that is arranged for reinforcement.

A stiffener 10 is inserted into each of the cell walls 113 of the hollow structure 110. The stiffener 10 may be a reinforced fiber having a mesh structure as illustrated in FIG. 2. However, the reinforced fiber having a mesh structure, included as the stiffener 10 is exemplary, and as long as a function as the stiffener 10 is provided, various materials may be used as the stiffener 10.

For example, a ceramic or a metal may be used as the stiffener 10. In addition, the stiffener 10 is inserted into each of the cell walls 113 arranged in a vertical direction or a horizontal direction. The stiffener 10 reduces a penetration speed of shells to obstruct a course of the shells fired in various directions, thereby ultimately suppressing penetration through the cell walls 113.

Referring to FIG. 4, at least one connection hole 114, through which the hollow portions 111 formed in the cells 112 of the cell walls 113 may be fluidly connected to one another, may be formed in each of the cell walls 113. The connection hole 114 is formed in each of the cell walls 113 when casting the hollow structure 110, as a result of inserting an annular tube 30 between molds 20 which are to be described later. The tube 30 still maintains the form of the hollow portions 111 even when the air is blown into the molds 20, which are flexible and installed to form the hollow portions 111, to expand the molds 20 and materials such as concrete is poured thereinto. Moreover, the tube 30 may function as a path through which the hollow portions 111 are filled with a fluid 130 (see FIG. 5), which will be described later, by allowing the fluid 130 to flow into each of the hollow portions 111 after the cell walls 113 are formed. Here, although one connection hole 114 formed in each of the cell walls 113 is illustrated, this is exemplary, and a plurality of connection holes 114 may also be formed according to necessity. While the tube 30 which is annular is inserted into spaces between the molds 20 which will be described later, this is exemplary, and a connection unit for connecting the molds 20 may be formed in various manners.

The filler 130 is selectively filled in the hollow portions 111 of the cells 112. The filler 130 may be a nonflammable fiber. The nonflammable fiber 130 locally restricts a penetration path of shells of an enemy, and protects the interior (of the defense structure 100?) from fire which is likely to break out by bombardment.

Moreover, as illustrated in FIG. 6, a fluid 130' may be filled in the hollow portions 111. The fluid 130' functions as a nonflammable material to retard fire broken out by enemy's shelling. In addition, the fluid 130' may have a viscosity so that inertia of shells that pass through the cells 112 by shelling attacks is delayed. The fluid 130' having a viscosity as above ultimately restricts damages to the defense structure 100 for national defense according to the current embodiment of the present invention. The fluid 130' is filled into the hollow portions 111 of the cells 112 through the connection hole 114 described above.

The cladding 120 surrounds the outside of the hollow structure 110 to be coupled thereto. The cladding 120 may also be formed of any material as long as a stress may be structurally maintained. That is, the cladding 120 may be formed of concrete, a ceramic, a synthetic resin material, or a metal. Alternatively, the cladding 120 may be formed of a plurality of panels having a finishing function; in this case, the panels are integrally coupled without any gap, according to the form of the hollow structure 110, outside the hollow structure 110 in each direction. In addition, the cladding 120 may be formed of various materials that form the outside of the structure. According to necessity, the cladding 120 may be formed of a stiffener such as a reinforcing bar or a reinforcing fiber that is arranged for reinforcement.

Meanwhile, while the cells 112 that form the hollow structure 110 in a three-dimensional pattern and have a rectangular cross-section are illustrated in FIGS. 1 through 6, this is exemplary, and the cells 112 may have various forms.

Figure 7:
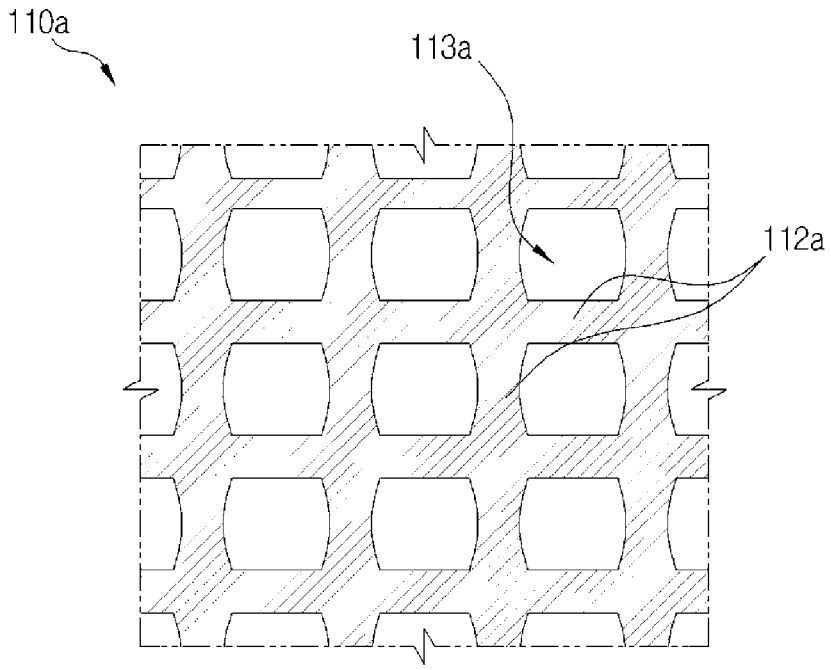
FIGS. 7 through 9 are cross-sectional views illustrating cells that form a hollow structure illustrated in FIG. 1, according to various modification examples of the present invention.
Figure 8:
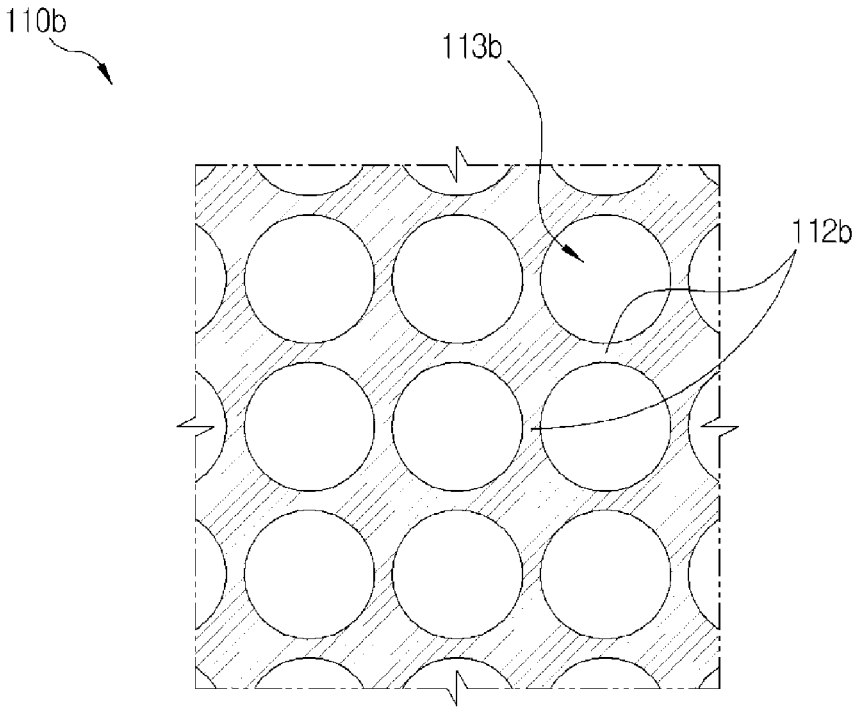
Figure 9:
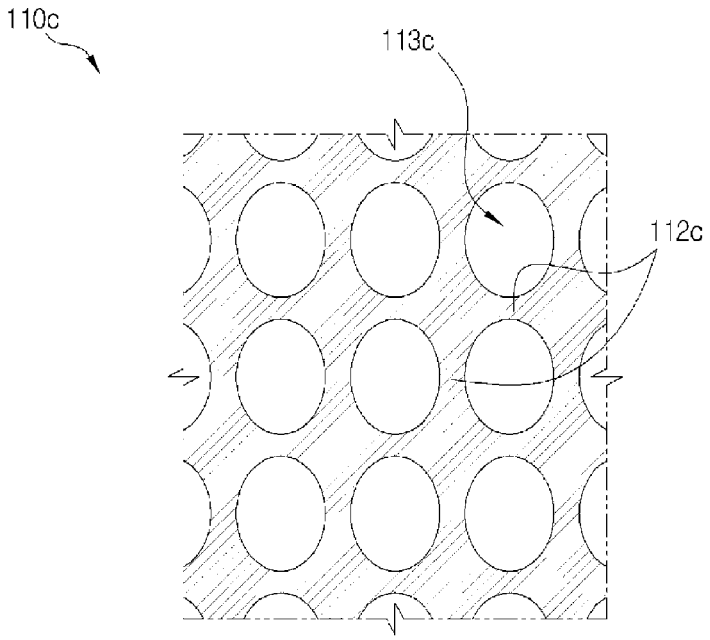

FIGS. 7 through 9 are cross-sectional views illustrating cells 112*a*, 112*b*, and 112*c* that form hollow structures 110*a*, 110*b*, and 110*c*, according to various modification examples of the present invention. Here, FIGS. 7 through 9 respectively illustrate the cells 112*a*, 112*b*, and 112*c* that form the hollow structures 110*a*, 110*b*, and 110*c* illustrated in FIG. 1 according to another embodiments of the present invention.

As described above, the cells 112 that form the hollow structure 110 may have not only a polygonal cross-section such as a rectangle but also a form formed by a smooth curved line. Moreover, as illustrated in FIG. 7, a cross-section of the cells 112*a* may be a closed shape formed by combining a curved line and a straight line. Also, as illustrated in FIGS. 8 and 9, the cells 112*b* and 112*c* may have a circular cross-section (see FIG. 8) and an oval cross-section (see FIG. 9), respectively. The shapes of the cross-sections of the cells 112 (112*a*, 112*b*, and 112*c*) provide broad inner space and make complicated development paths for cracks at the same time. Thus, if the structure is damaged due to an impact caused by internal and external factors, the extent of damage may be minimized.

Hereinafter, a method of manufacturing a defense structure for national defense according to an embodiment of the present invention will be described with reference to the attached drawings.

Figure 10:
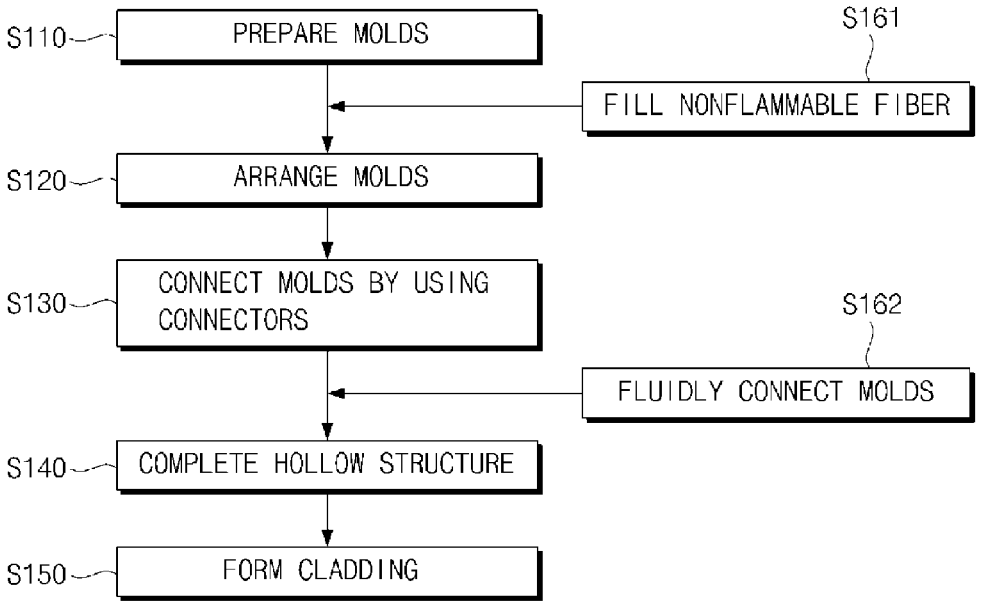
FIGS. 10 and 11 are flowcharts of a method of manufacturing a defense structure for national defense, according to embodiment of the present invention, respectively illustrating an embodiment in which a nonflammable fiber is filled in molds and an embodiment in which a fluid is filled in molds.
Figure 11:
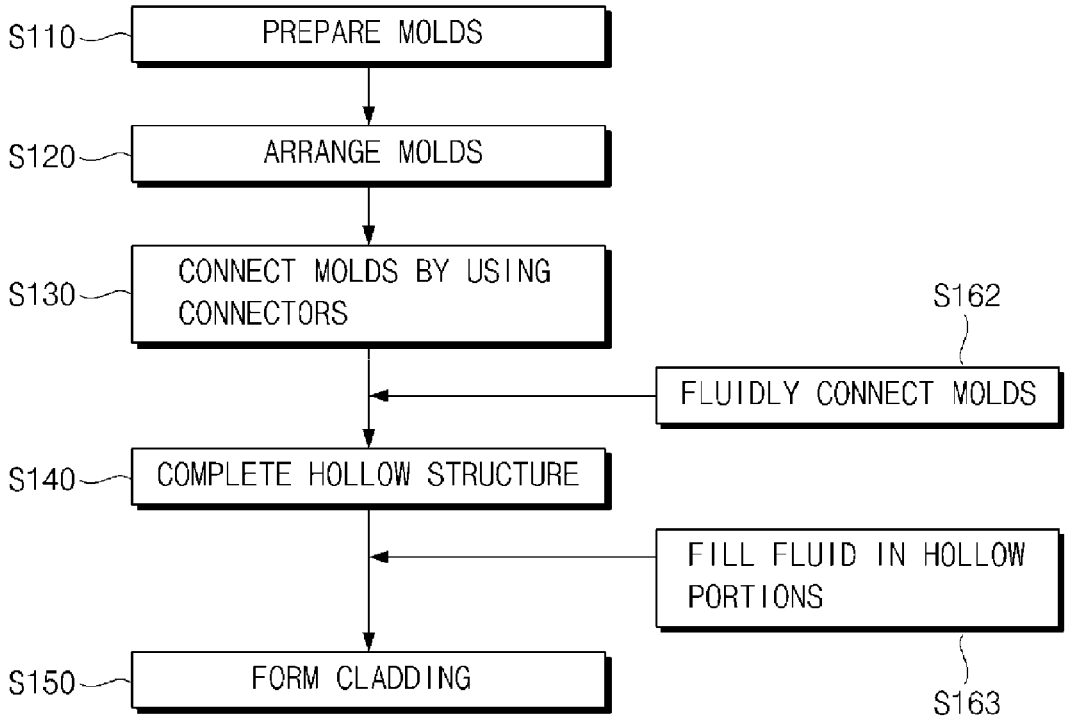
Figure 12:
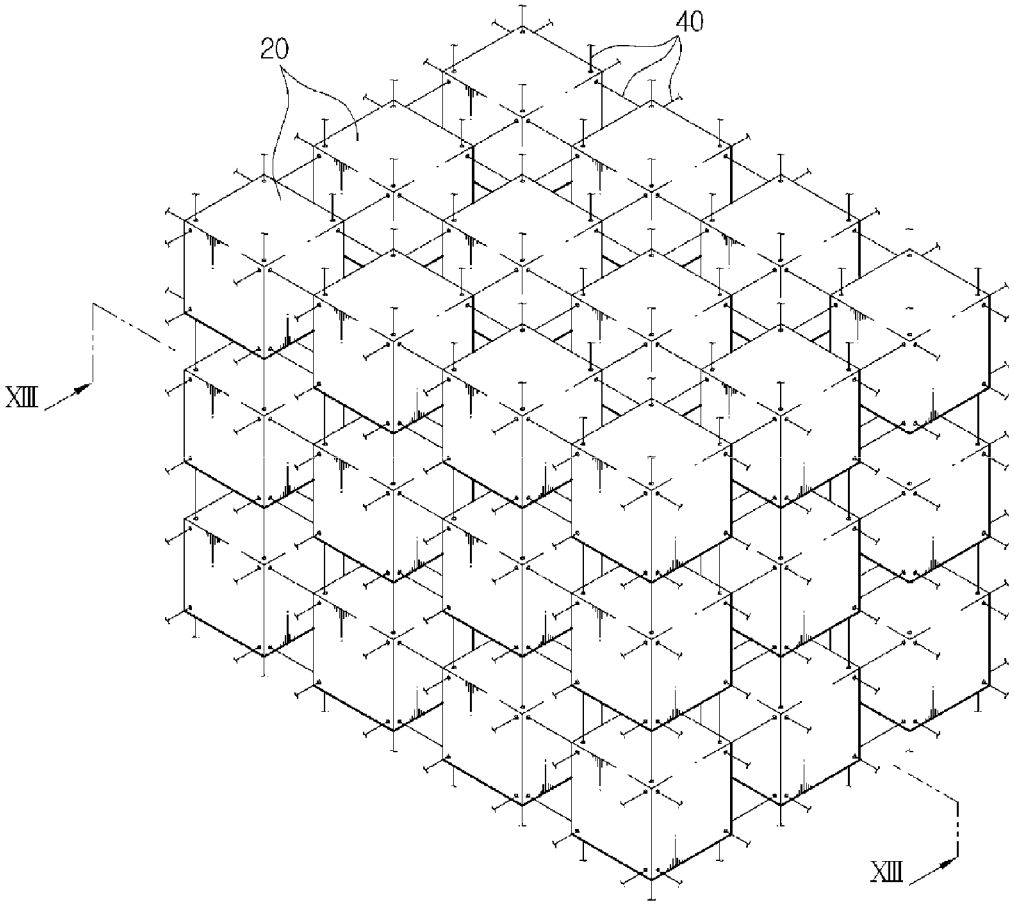
FIG. 12 is a perspective view to explain a method of manufacturing the defense structure for national defense illustrated in FIGS. 10 and 11.
Figure 13:
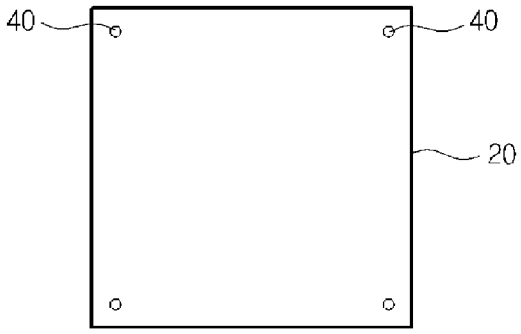
FIG. 13 is a cross-sectional view cut along a line XIII-XIII of FIG. 12.

FIGS. 10 and 11 are flowcharts of a method of manufacturing a defense structure for national defense, according to embodiments of the present invention, respectively illustrating an embodiment in which a nonflammable fiber 130 is filled in molds 20 and an embodiment in which a fluid 130' is filled in molds 20. FIG. 12 is a perspective view to explain a method of manufacturing the defense structure 100 for national defense illustrated in FIGS. 10 and 11. FIG. 13 is a cross-sectional view cut along a line XIII-XIII of FIG. 12. Here, like reference numerals as those of FIGS. 1 through 6 denote like elements that have the same structure and perform the same function, and thus repeated description thereof will be omitted.

In addition, in regard to the method of manufacturing a defense structure for national defense, the hollow structure 110 having a rectangular parallelepiped shape will be described for the purpose of description of the method is to describe a method of manufacturing in which the plurality of cells 112 are arranged three-dimensionally.

As illustrated in FIG., in order to manufacture the defense structure 100 for national defense according to the current embodiment of the present invention, first, a plurality of molds 20 having an external shape corresponding to the hollow portions 111 formed in the cells 112 included in the hollow structure 110, which is to be completed, are prepared in operation S110.

The molds 20 may preferably be formed of a soft material having flexibility so that the molds 20 do not greatly affect rigidity of the cell walls 113. For example, the molds 20 may be formed of a plastic or an inflated vinyl, but is not limited thereto. Also, as described above, the hollow portions 111 formed in the cells 112 may have various shapes including a hexahedral shape, and thus, repeated description will be omitted. The molds 20 have an external shape corresponding to the shape of the hollow portions 111.

Next, the plurality of molds 20 are arranged to correspond to a set, three-dimensional pattern in operation S120. Here also, as described above, the set three-dimensional pattern may be in various forms including a hexahedral shape, and repeated description thereof will be omitted.

When the molds 20 are arranged in the set, three-dimensional pattern, the stiffener 10 (see FIGS. 2 and 3) such as a reinforcing fiber having a mesh structure may be inserted into spaces between the plurality of molds 20.

Next, the plurality of molds 20 may be supported by and connected to one another by using a plurality of connectors 40 in operation S130. Here, the connectors 40 may be, for example, tensioned strings or pins, but are not limited thereto.

The tensioned strings or pins may be fixed to a cast (not shown) formed outside the cladding 120 during the manufacturing process and a tension may be applied to the strings or the pins. Meanwhile, while the connectors 40 such as tensioned strings or pins that are passed through the molds 20 are illustrated in FIGS. 12 and 13, this is exemplary, and the molds 20 may also be connected to the connectors 40 such as strings or pins by using an auxiliary bonding material such as a Velcro at corner portions of the molds 20.

Next, the cell walls 113 are formed by filling spaces between the molds 20 with a fluid material that is suitable for the purpose, and the cell walls 113 are cured to complete the hollow structure 110 in operation S140. The fluid material for forming the cell walls 113 may be any material as long as a stress may be structurally maintained. That is, the cell walls 113 may be formed of concrete, a ceramic, a synthetic resin material, an autoclaved lightweight concrete (ALC) or a metal. Also, according to necessity, a stiffener such as a reinforcing bar or a reinforcing fiber that is arranged for reinforcement may be used as a fluid material to fill the spaces.

Next, the cladding 120 surrounding the outside of the hollow structure 110 is formed in operation S150. The cladding 120 may also be formed of any material as long as a stress may be structurally maintained. That is, the cladding 120 may be formed of concrete, a ceramic, a synthetic resin material, or a metal, and a stiffener such as a reinforcing bar or a reinforcing fiber that is arranged for reinforcement may be used to form the cladding 120 according to necessity.

Meanwhile, as illustrated in FIG. 10, operation S161 of filling the nonflammable fiber 130 into the molds 20 may be included between operation S110 of preparing the molds 20 and operation S120 of arranging the molds 20. Here, the molds 20 may surround the nonflammable fiber 130 to thereby tightly seal the same, and the plurality of molds 20 as above are arranged. However, operation S161 of filling the nonflammable fiber 130 may also be performed after arranging the molds 20 in operation S120, and may be selectively applied in consideration of convenience in regard to the manufacture.

Alternatively, as illustrated in FIG. 11, operation S163 of filling the fluid 130' into the hollow portions 111 may be included between operation S140 of completing the hollow structure 110 and operation S150 of forming the cladding 120. The fluid 130' is filled into the hollow portions 111 through the connection hole 114 formed in each of the cell walls 113.

Best Mode

Figure 16:
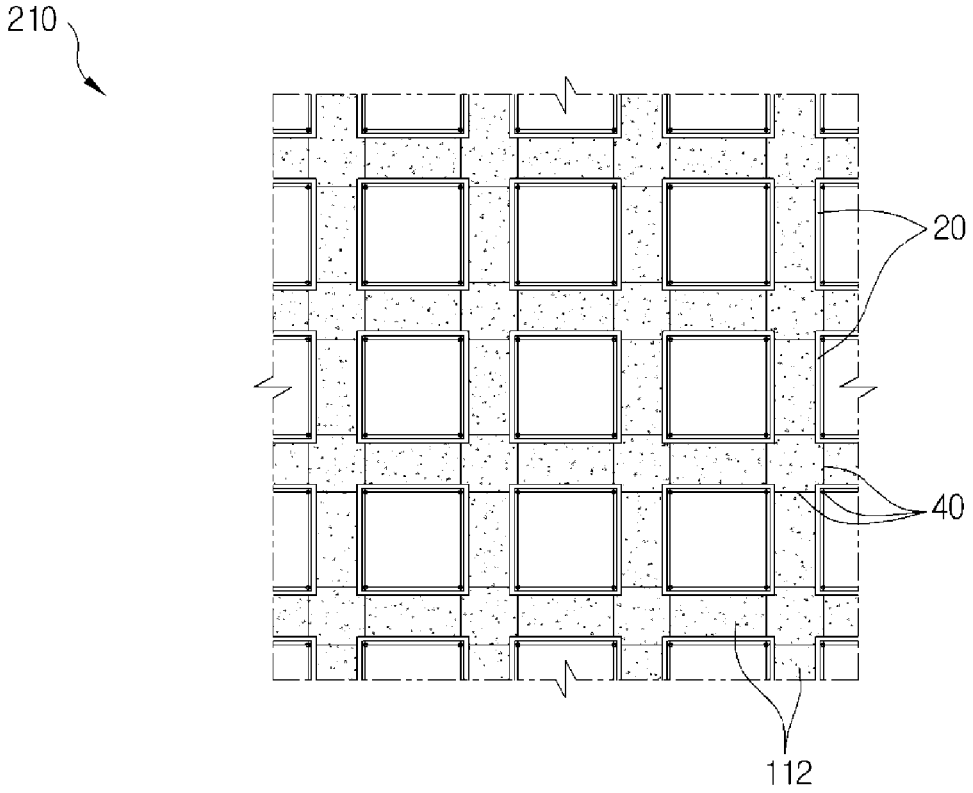
FIG. 16 is a cross-sectional view of a defense structure for national defense according to another embodiment of the present invention, which is manufactured by using the method of manufacturing illustrated in FIGS. 12 and 13.

According to the method of manufacturing a defense structure for national defense as described above (operations S110 through S150), the defense structure for national defense according to another embodiment of the present invention as illustrated in FIG. 16 is completed.

Referring to FIG. 16, the defense structure for national defense according to above-described embodiment includes a hollow structure 210 and a cladding 120. The hollow structure 210 is necessarily included for the manufacture, and may further include a plurality of molds 20 that tightly contact inner walls of the plurality of cells 120 by surface contact. The molds 20 may preferably be formed of a soft, flexible material such as a plastic or an inflated vinyl, but is not limited thereto.

Also, the hollow structure 210 may further include a plurality of connectors 40 that pass through the cell walls 113 to respectively connect and support the plurality of molds 20. Here also, tensioned strings or pins may be used as the connectors 40, but the connectors 40 are not limited thereto.

Figure 17:
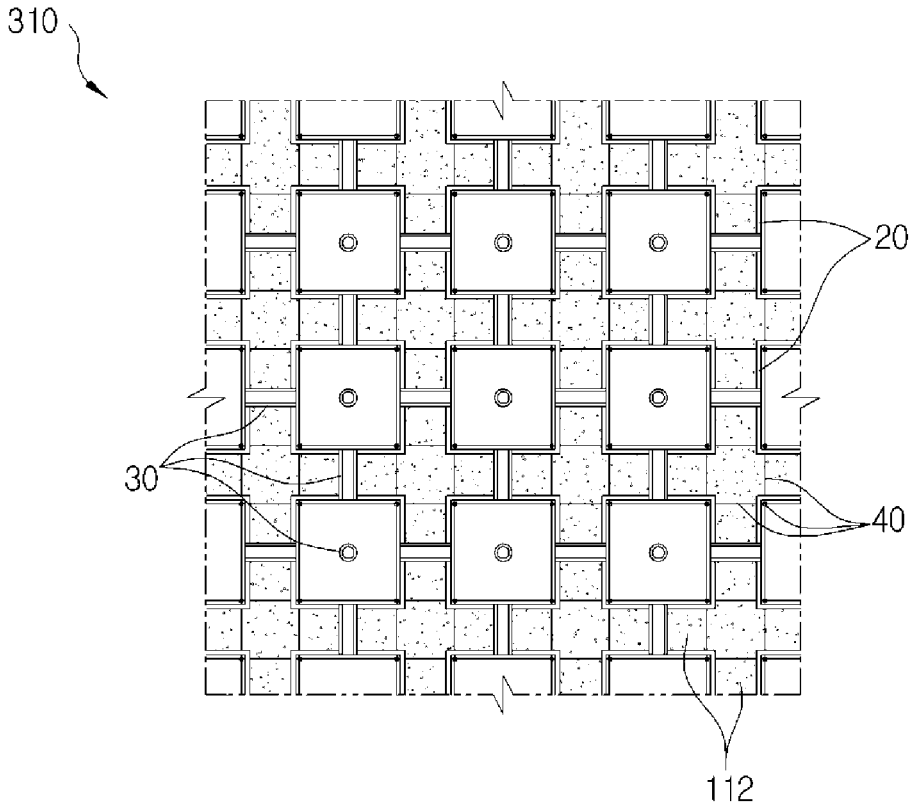
FIG. 17 illustrates a defense structure for national defense according to another embodiment of the present invention, which is manufactured by using the method of manufacturing of FIGS. 14 and 15.

According to the method of manufacturing a defense structure for national defense as described above (operations S110 through S163), the defense structure for national defense according to another embodiment of the present invention as illustrated in FIG. 17 is completed.

Figure 14:
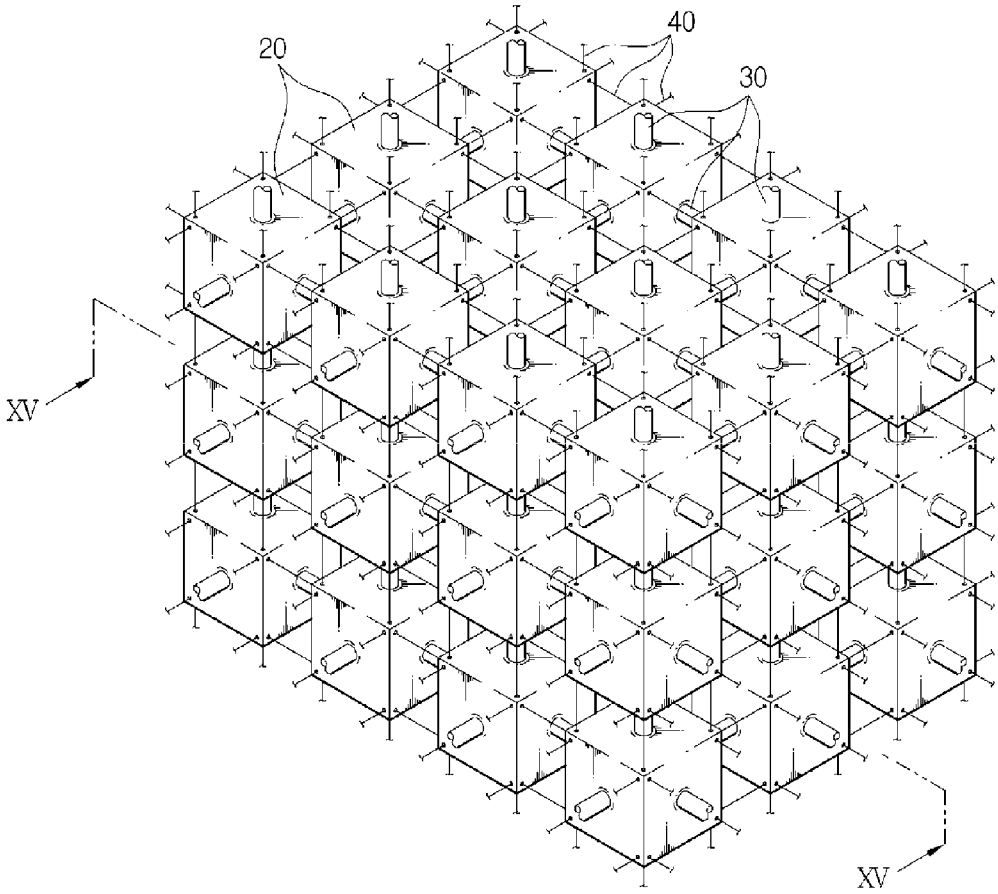
FIG. 14 is a perspective view illustrating an operation of fluidly connecting molds to one another, in the method of manufacturing a defense structure for national defense illustrated in FIGS. 10 and 11.
Figure 15:
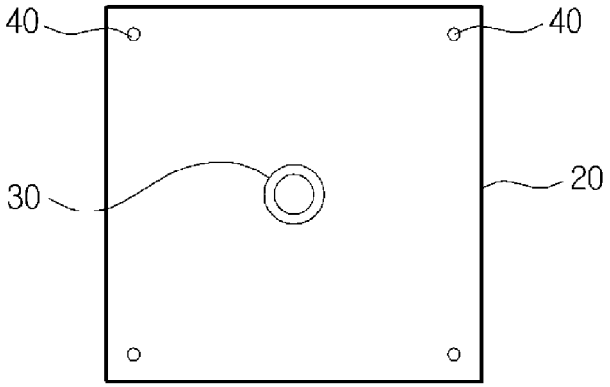
FIG. 15 is a cross-sectional view cut along a line XV-XV of FIG. 14.

The defense structure for national defense according to above-described embodiment includes a hollow structure 310 and a cladding 120. The hollow structure 310 further includes at least one tube 30 inserted into the connection hole 114 as illustrated in FIGS. 14 and 15 which are perspective views to explain the manufacturing method. In the method of manufacturing a defense structure for national defense as described above (operations S110 through S163), the tube 30 may be used to fill the fluid 130' into the hollow portions 111 formed in the plurality of cells 112 (operation S163). Examples of the fluid 130' include not only a viscous liquid but also a liquid containing a functional additive, according to necessity.

Figure 18:
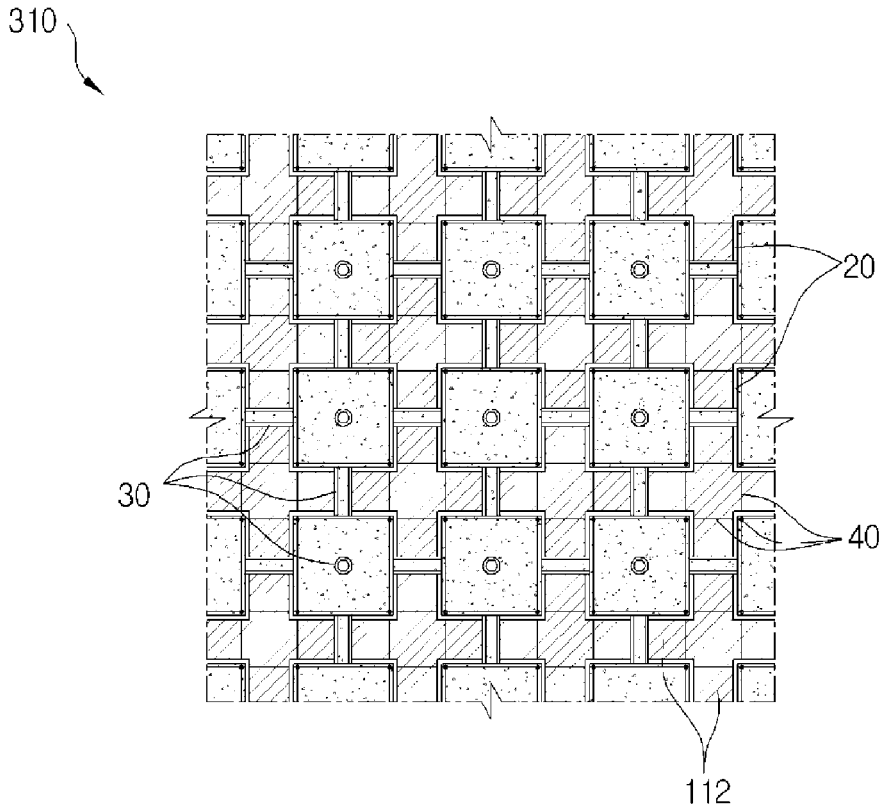
FIG. 18 is a cross-sectional view illustrating the defense structure for national defense structure of FIG. 14, in which a fluid is filled in cells.

Meanwhile, according to the method of manufacturing a defense structure for national defense (operations S110 through S163) as described above, a defense structure for national defense as illustrated in FIG. 18 is completed. In the hollow structure 310 of the defense structure for national defense as described above, each of the hollow portions 111 in the cells 112 is filled with a fluid 130' having a fluidity.

As described above, according to the defense structure for national defense of the embodiments of the present invention, as a plurality of cells are partitioned by cell walls, and the hollow portions are formed in the cells, the total weight of the defense structure may be reduced but appropriate rigidity and strength thereof may be maintained compared to the reduced weight. Moreover, the plurality of cells are arranged in a set, three-dimensional pattern and the hollow portions are formed in the cells, and thus, development of cracks due to an impact applied over the whole walls by shells or missiles may be delayed, thereby locally restricting damages to defense walls. In addition, a stiffener such as a reinforced fiber having a mesh structure is inserted into the cell walls, thereby suppressing penetration by shells of an enemy.

Furthermore, in the hollow structure, the hollow portions formed by the cells are filled with a nonflammable fiber or a functional fluid to thereby locally restrict fire which may break out by shelling attacks or a penetration path of shells, thereby ultimately reducing inertia of the shells.

While the present invention has been particularly shown and described with reference to exemplary embodiments thereof, it will be understood by those of ordinary skill in the art that various changes in form and details may be made therein without departing from the spirit and scope of the present invention as defined by the following claims.

[Explanation of Reference numerals]

100: defense structure for national defense
110(100a, 100b, 100c), 210, 310: hollow structure
111: hollow portion 112(112a, 112b, 112c): cell 113(113a, 113b, 113c): cell walls 114: connection hole
120: cladding 130: nonflammable fiber
130': fluid 10: stiffener
20: mold 30: tube
40: connector

INDUSTRIAL APPLICABILITY

The present invention may be applied in a defense structure for national defense that is safe against shells or missiles.

The invention claimed is:

1. A defense structure, comprising:

a hollow structure comprising a plurality of three-dimensional-cells, a plurality of hollow portions formed by a hollow structure in each of the plurality of cells, each cell being partitioned by a cell wall, and the hollow structure, fixed to a ground, comprising a plurality of molds and connectors which passing through the a cell wall to connect the plurality of molds wherein the plurality of cells forming the hollow structure are arranged in a three-dimensional pattern and the plurality of the hollow portions formed in each cell wall are fluidly connected to one another by the connectors;

a cladding formed to surround an outside of the hollow structure; and a filler provided selectively to fill in the hollow portions of the plurality of cells.

2. The defense structure of claim 1, wherein the filler comprises a nonflammable fiber or a fluid.

3. The defense structure of claim 1, wherein at least one stiffener is inserted into one of cell walls.

4. The defense structure of claim 1, wherein at least one connection hole through which the plurality of hollow portions formed in the plurality of cells are fluidly connected to one another, the at least one connection hole is formed in each of the plurality of cell walls.

5. The defense structure of claim 4, further comprising:

a plurality of tubes that are respectively inserted into connection holes.

6. The defense structure of claim 1, wherein the plurality of cells have a cross-section having a form at least one of a circle, an oval, a polygon, and a closed shape formed by combining a curve and a straight line.

7. A defense structure, comprising:

a hollow structure comprising a plurality of three-dimensional-cells, a plurality of hollow portions formed by a hollow structure in each of the plurality of cells, each cell being partitioned by a cell wall, and the hollow structure, fixed to a ground, comprising a plurality of molds and connectors which passing through a cell wall to connect the plurality of molds, wherein the plurality of cells forming the hollow structure are arranged in a three-dimensional pattern and the plurality of the hollow portions formed in the each cell wall are fluidly connected to one another by the connectors;

a cladding formed to surround an outside of the hollow structure; and a filler provided selectively to fill in the hollow portions of the plurality of cells, wherein the plurality of molds that respectively tightly contact inner walls of the plurality of cells by surface contact, and wherein the molds comprise soft material having flexibility and the molds are formed by one of a plastic or an inflated vinyl.

8. The defense structure for national defense of claim 7, further comprising:

a plurality of connectors that respectively pass through the plurality of cell walls to connect and support the plurality of molds.

* * * * *